United States Patent [19]

Pounds

[11] 4,365,120

[45] Dec. 21, 1982

[54] ILLUMINATED KEYBOARD

[75] Inventor: Walter R. Pounds, Lafayette, Colo.

[73] Assignee: KB Denver, Inc., Frederick, Colo.

[21] Appl. No.: 253,814

[22] Filed: Apr. 13, 1981

[51] Int. Cl.[3] ..... H01H 13/70

[52] U.S. Cl. ..... 200/5 A; 200/314

[58] Field of Search ..... 200/5 A, 159 B, 310, 200/314, 317

[56] References Cited

U.S. PATENT DOCUMENTS

| | | | |
|---|---|---|---|
| 4,056,701 | 11/1977 | Weber | 200/314 |
| 4,088,855 | 5/1978 | Emery | 200/314 X |
| 4,163,138 | 7/1979 | Harden | 200/5 A X |
| 4,262,182 | 4/1981 | Basler et al. | 200/314 |
| 4,264,799 | 4/1981 | Aspden | 200/314 |
| 4,302,647 | 11/1981 | Kandler et al. | 200/314 X |
| 4,320,268 | 3/1982 | Brown | 200/314 X |

*Primary Examiner*—J. R. Scott

*Attorney, Agent, or Firm*—Lloyd L. Zickert

[57] ABSTRACT

An apparatus for illuminating keyboard or individual switches in which a conventional plastic contact actuator member is fabricated of translucent material so that it may function additionally as a conductor and diffuser of light. A lamp source is positioned in the center of a conventional dome-printed circuit switch within holes provided in the metal contact domes and the substrate of the switch. The actuator includes a cylindrical lower hood portion having a recess in the center thereof permitting it to receive the lamp source upon switch actuation.

6 Claims, 6 Drawing Figures

FIG. 1.
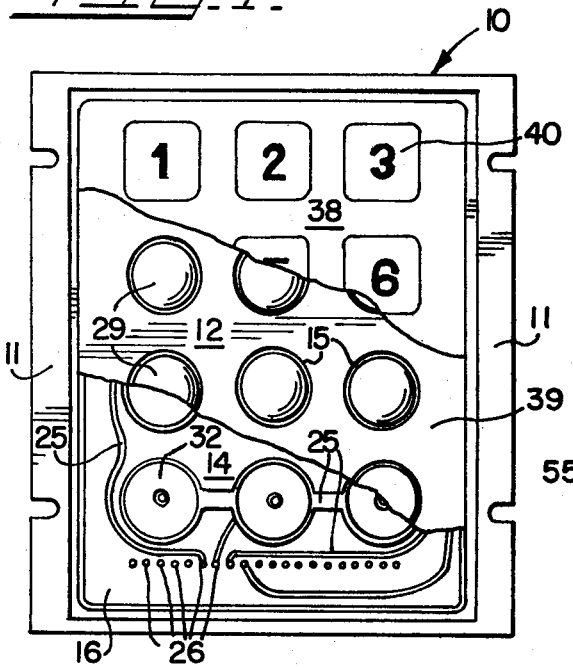
FIG. 3.
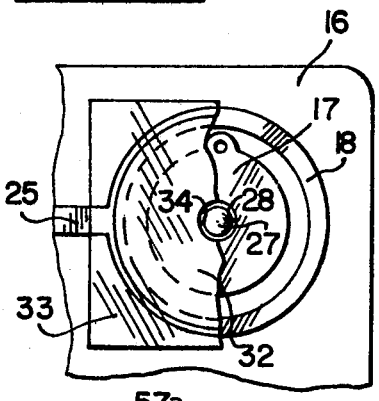
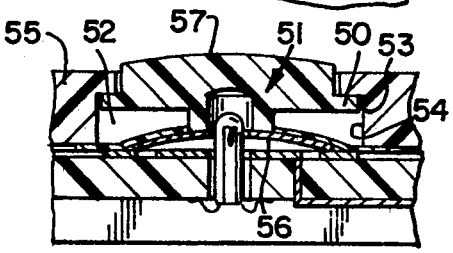
FIG. 2.
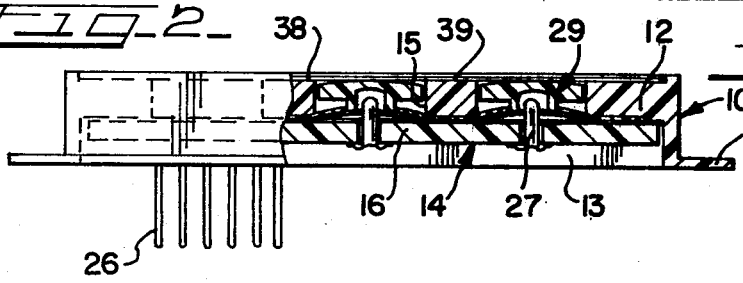
FIG. 5.
FIG. 4a.
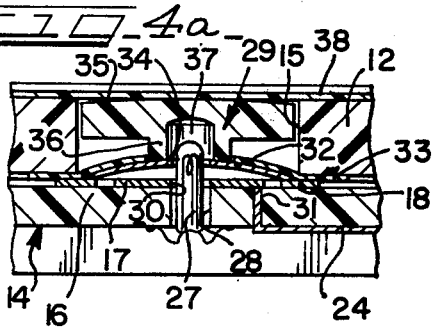
FIG. 4b.
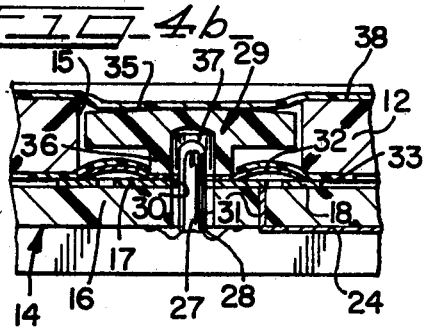

ILLUMINATED KEYBOARD

BACKGROUND OF THE INVENTION

This invention relates to illuminated keyboards of the type commonly employed in a variety of applications including computers and calculators, games, control devices, and numerous electrical appliances. In particular, this invention discloses a straightforward and economical illuminated keyboard adaptable to continuous keyboard illumination or illumination only upon actuation of a given keyboard switch.

Prior keyboards have been complex and often require a separate wafer or other member to conduct and diffuse the light to the keyboard surface. The keyboard of this invention, however, utilizes no separate or additional components, except the lamp itself, to provide versatile illuminating capability.

This economical design is accomplished by combining a light source, which is integrally mounted within a dome switch, with a novel plastic switch actuator cap that performs a double function. First, the cap functions in a conventional manner to transmit the actuation force to the contacts below and, second, the cap receives light from a small incandescent lamp thereby conducting and diffusing the light over the cap or "button" surface. Thus, it can be seen that no additional hardware is required to effect illumination of this keyboard.

An object of this invention, therefore, is to provide an illuminated keyboard switch of economical design.

Another object of this invention resides in the provision of an illuminated keyboard containing few additional components as compared with similar non-illuminated keyboards.

Yet another object is to provide an illuminated keyboard switch in which a plastic actuator cap functions also to conduct and diffuse the light from an illuminating lamp source to the switch surface.

BRIEF DESCRIPTION OF THE DRAWINGS

Other objects, features and advantages of the invention will be apparent from the following detailed disclosure, taken in conjunction with the accompanying sheet of drawings, in which:

FIG. 1 is an overall front view of the switch assembly employing the illumination technique of this invention with portions cut away to reveal underlying structural details;

FIG. 2 is a side view of the switch assembly with a partial section taken substantially along line 2—2 of FIG. 1 to reveal switch location and mounting features;

FIG. 3 is a top view showing the metallized contacts of a typical switch of this keyboard;

FIG. 4*a* is an enlarged sectional view taken substantially along line 4—4 of FIG. 1 of a typical switch of this keyboard as it appears when not actuated;

FIG. 4*b* is the switch of FIG. 4*a* as it appears when actuated; and

FIG. 5 is an enlarged sectional view of a typical switch of this keyboard employing a self-retaining actuator cap.

BRIEF DESCRIPTION OF THE PREFERRED EMBODIMENTS

FIGS. 1 and 2 illustrate a typical keyboard employing the illumination principles of this invention. The keyboard shown contains twelve identical key switches arranged into a three column, four row matrix of the form commonly utilized in telephone tone signaling applications. The principles taught herein, however, may be applied equally to other keyboard configurations or to the illumination of individually packaged switch units.

A molded plastic housing 10 forms a chassis into which the switches are secured. Parallel flanges 11 for mounting the keyboard unit are provided along two opposing sides of housing 10. The large center portion of housing 10 forms a rectangular actuator cap retaining and switch mounting frame 12 which is raised above the level of the flanges so as to create a corresponding rectangular space 13 into which a printed circuit switch assembly 14 is fitted. Twelve holes 15 are provided through frame 12, each hole being positioned and centered directly above a corresponding switch located on the printed circuit switch assembly 14.

The printed circuit switch assembly 14 consists of a rigid printed circuit substrate 16, such as glass epoxy, upon which top and bottom metallized foil patterns are etched or plated. These metallized foil patterns form the basic contact surfaces 17 and 18 of the twelve switches comprising assembly 14 and all necessary interconnecting runners 24 and 25. Twenty equally spaced pins 26 are positioned along the lower edge of printed circuit substrate 16 forming an electrical connector thereon. Connector pins 26 are connected by foil runners 24 and 25 to respective switch contacts 17 and 18 and to lamps 27.

Small holes 28 of approximately 3/32 inch diameter are provided through printed circuit substrate 16 at the center of each switch into which a small incandescent lamp 27 is placed. Each lamp is mounted by its wire leads and soldered to adjacent foil pads on the bottom of substrate 16. The lamps may extend above the upper surface of substrate 16, as discussed below, to assure proper coupling of the light from lamps 27 into actuator caps 29.

FIGS. 3 and 4 illustrate a dome switch of the type employed on switch assembly 14. A circular inner contact 17, having a hole 30 in the center thereof through which lamp 27 may protrude, and an annular outer contact ring 18 are formed on the top surface of substrate 16 at each switch location. Plated-through hole 31 and runner 24 connect inner contact 17 with a respective connector pin 26. Similarly, connection is made to the outer contact ring 18 by upper surface runner 25.

A circular dome-shaped conductive and resilient contact element 32, generally referred to as a dome, is positioned over outer ring 18 and centered thereon. Dome 32 is dimensioned so that its outer perimeter rests entirely within the contact area of outer ring 18. Dome 32 is fabricated of conventional material having the requisite resilient and conductive properties. A thin sheet of electrically insulative material 33, having lineal dimensions somewhat greater than the diameter of dome 32 and with a central opening therethrough at least the size of a hole 34 in the dome, is positioned over dome 32 and attached by adhesive to the dome and to substrate 16 thereby restraining dome 32 in the above described position.

A second and generally identical dome is positioned directly above the first dome and restrained by a second sheet of insulative material. (The second dome and insulative sheet are not shown in the figures for clarity.) This second or upper dome augments the first or lower dome 32 and functions to provide the necessary switch spring return and to secure the desired "tactile" touch upon switch actuation. Both dome members contain holes 34 through which lamp 27 may protrude. These holes 34 do not materially weaken or affect the proper resilient action of domes 32.

Switch assembly 14, upon which twelve of the above described switches are formed, is rigidly secured to frame 12 by self-tapping screws which extend through holes provided in substrate 16 into corresponding holes in frame 12. An actuator cap 29 is positioned in each frame hole 15 and rests upon the respective switch domes 32 so that upper surface 35 of the cap is level or slightly raised with respect to the top of frame 12. Each actuator cap 29 includes a cylindrical lower hood portion 36 having a recess 37 of sufficient dimension therein to permit the unrestricted entry of associated lamp 27 as may be required upon switch actuation.

Lamps 27 are positioned in respective holes 28 and mounted by associated leads to interconnecting runners and pads 24 on the bottom surface of substrate 16. Lamps 27 may extend substantially above substrate 16, as illustrated in FIG. 4, to assure adequate coupling of the light from each lamp into its respective actuator cap 29 when the actuator is depressed to trip the dome switch aligned therewith.

Actuator caps 29 are molded from a nylon or plastic material having translucent properties which permit the light from lamps 27 positioned below or within the hood portions 36 of actuator caps 29 to be conducted to, and evenly diffused over, the entire upper actuator surfaces 35. In this manner the circular profile of each switch is clearly visible when viewed from above. While actuator caps of circular cross section are shown, it shall be understood that actuators of any convenient style and dimension as, for example, square or polygonal, are contemplated by this invention.

A translucent plastic or polyester sheet 38 or other similar material is affixed to the upper frame surface 39. This sheet functions to contain actuator caps 29 and may be screened with appropriate designs, logos, and key switch numbers or other designations 40. Thus, a readily visible means of keyswitch identification is available merely by screening opaque key designations or indicia 40 above respective actuator caps 29.

Mechanical and electrical operation of the switches of this keyboard is illustrated by FIGS. 4*a* and 4*b*. FIG. 4*a* shows a switch as it appears, generally, when not being actuated. Dome 32 forms an electrical contact along its perimeter with outer contact ring 18 but, due to its curved or domed shape, remains elevated above inner contact 17 and, therefore, not in contact with that surface. An electrical "open circuit" results.

Actuation of the switch is accomplished by the application of a downward force upon actuator cap 29. This force is transmitted through this rigid cap generally to the center portion of the upper dome, thereby deforming and indenting both upper and lower domes 32 until contact is achieved with inner contact 17 as shown in FIG. 4*b*. In this position, an electrical connection is formed between inner contact 17 and outer contact ring 18 through the lower metallic contact dome 32. The switch is electrically "closed" and remains so until removal of the downward actuation force at which instant the resilient domes "snap" back to their original non-indented shape. This electrically opens the switch and urges the actuator cap 29 upwardly to its preactivated position.

A second embodiment is illustrated in FIG. 5 which differs principally in that the overlay is omitted and the actuator caps are exposed to the user. In this embodiment an annular flange 50 is provided along the lower perimeter of actuator cap 51 which slidably seats within an annular corner groove 52 defined by annular surfaces 53 and 54 formed in mounting frame 55.

In the absence of an external force of actuation, the internal spring force of resilient dome 56 urges actuator cap 51 upwardly until flange 50 contacts surface 53 of corner groove 52. This interference precludes further upward movement of actuator cap 51, thereby retaining this cap within the keyboard assembly.

This self-retaining feature obviates the requirement for a translucent actuator retaining sheet such as shown in FIG. 2 at 38 and, typically, none are employed in keyboards of this design. Without such a sheet, actuator caps 51 may either protrude above the top surface of frame 55 or remain substantially flush with this surface in accordance with design criteria not important to this invention. Individual actuator caps 51 may be screened or otherwise marked with appropriate key designations or indicia 57 as described above. In all other material respects, the illumination and switch operation of this embodiment is the same as that described above.

From the foregoing, it can be appreciated that this invention pertains to an economical and versatile technique for illuminating keyboard switches of the dome type requiring no additional components except the lamp itself. This is made possible by the novel design of actuator cap 29 (51) in combination with a dome switch into which a lamp 27 has been integrally placed. By providing a hole through the center of an otherwise conventional dome switch and by positioning a lamp 27 therein, the actuator 29 (51) of this invention functions in a dual capacity not only as a conventional actuation force interface element, but also as a conductor and diffuser of the light emanating from the lamp integrally contained within such dome switch. Thus, little added complexity, components, or expense is necessary to create dome switch keyboard illumination when the teachings of this invention are utilized.

It will be understood that modifications and variations may be effected without departing from the scope of the novel concepts of the present invention and that this application is to be limited only by the scope of the appended claims.

The invention is hereby claimed as follows:

1. An illuminated electrical keyboard comprising a housing; a switch assembly; and an optically translucent switch actuator means, said switch assembly including a substrate having at least one electrical switch thereon, said switch having a point of actuation and an integral light generating means, said electrical switch including, an annular outer ring contact, a circular inner contact centered therein, both contacts on the top face of said substrate, a circular dome-shaped resilient conductive member having a hole through the center thereof, the area adjacent said hole defining the point of actuation, the periphery of the conductive member maintaining substantially continuous electrical contact with said outer ring contact, said point of actuation being resiliently deformed upon switch actuation from a first point of electrical non-engagement above the inner contact to a second point of electrical engagement on said inner contact, said light generating means emitting light from said switch substantially at the point of actuation and being secured to the substrate below the hole in said conductive member such that said conductive member does not physically contact the light generating means upon switch actuation, said emitted light traveling through said hole into said region for receiving light on said actuator, connector means on said substrate for making external electrical connection to the switch assembly, conductor means on the substrate which interconnects the switch, the light generating means, and the connector means, said optically translucent actuator means having a region for engaging said point of actuation and for receiving light emitted from the light generating means, and a visible top face, said actuator functioning, first, to transmit an external force of switch actuation applied to the visible top face to the point of actuation and, second, to conduct said received light to the visible top face, said housing having means for securing said switch assembly in fixed relationship to said housing, means for positioning and guiding said actuator adjacent the point of actuation, and said housing having means for retaining the actuator.

2. The illuminated electrical keyboard of claim 1 in which said actuator means includes:

(a) a uniform cross-sectional body having said top face at one end thereof and said region for engaging the point of actuation at the opposite end thereof;

(b) a recess in said region adapted to receive the light generating means.

3. The illuminated electrical keyboard of claim 1 in which said housing includes:

(a) a planar frame member of uniform thickness; said switch assembly being secured to the lower surface of said frame member;

(b) said positioning and guiding means comprising a substantially vertical aperture through said frame member centered over the electrical switch to slidably receive said actuator.

4. The illuminated electrical keyboard of claim 3 in which said retaining means comprises a thin translucent sheet secured to the upper surface of said frame member.

5. The illuminated electrical keyboard of claim 3 in which:

(a) said actuator further including a flange extending from said body and being positioned at the end of the body opposite the top face thereof; and (b) means coacting with said flange to allow movement of said actuator means to actuate said switch and serve as said retaining means.

6. An illuminated keyboard assembly having a plurality of key-operated switches which comprises, a frame having a plurality of openings each of which slidably receives a key actuator of translucent material so that it can function as a light diffuser and means coacting with the key actuators to maintain said actuators in working relationship with the frame, and a printed circuit board and switch subassembly received by said frame, said subassembly including a printed circuit board and a plurality of switches one each being in registry with a key actuator, each said switch having electrically insulated conductive paths on said printed circuit board and domes of electrically conductive material coacting with the conductive paths to selectively electrically connect the conductive paths upon tripping of the dome by movement of the key actuator aligned therewith, said subassembly further including a light generating lamp secured to the printed circuit board and extending upwardly from the conductive paths, said dome having an opening therethrough and said actuator having a recess aligned with said opening such that when the dome is tripped the light generating lamp will project through the dome and into the recess of the actuator such that the light will diffuse throughout the actuator.

* * * * *